US005234804A

United States Patent [19]

Sato et al.

[11] Patent Number: 5,234,804

[45] Date of Patent: Aug. 10, 1993

[54] PHOTOGRAPHIC PAPER SUPPORT WITH SILVER HALIDE EMULSION LAYER

[75] Inventors: Erika M. Sato; James L. Edwards; Larry D. Hagemeier, all of Rochester; David J. Lacz, Honeoye Falls, all of N.Y.

[73] Assignee: Eastman Kodak Company, Rochester, N.Y.

[21] Appl. No.: 941,025

[22] Filed: Sep. 4, 1992

[51] Int. Cl.[5] ..... G03C 1/775

[52] U.S. Cl. ..... 430/538; 430/531; 430/536; 430/539

[58] Field of Search ..... 430/531, 536, 538, 539

[56] References Cited

U.S. PATENT DOCUMENTS

| | | | |
|---|---|---|---|
| 4,283,486 | 8/1981 | Aono et al. | 430/505 |
| 4,331,508 | 5/1982 | Miyama et al. | 428/513 |
| 4,447,524 | 5/1984 | Uno et al. | 430/538 |
| 4,476,153 | 10/1984 | Kiritani et al. | 427/40 |
| 4,542,093 | 9/1985 | Suzuki et al. | 430/523 |
| 4,558,002 | 12/1985 | Aotsuka et al. | 430/538 |
| 4,657,846 | 4/1987 | Kokubo et al. | 430/434 |
| 4,755,454 | 7/1988 | Aotsuka et al. | 430/538 |
| 4,895,688 | 1/1990 | Shigetani et al. | 264/171 |
| 4,913,999 | 4/1990 | Tamagawa et al. | 430/138 |
| 4,921,781 | 5/1990 | Takamuka et al. | 430/496 |
| 4,968,554 | 11/1990 | Shigetani et al. | 428/216 |

FOREIGN PATENT DOCUMENTS

| | | |
|---|---|---|
| 0256381 | 2/1988 | European Pat. Off. . |
| 0305599 | 3/1989 | European Pat. Off. . |
| 63-2540447 | 10/1988 | Japan . |

*Primary Examiner*—Jack P. Brammer
*Attorney, Agent, or Firm*—Paul A. Leipold

[57] ABSTRACT

A photographic element comprising a paper substrate said paper substrate comprises wood fiber and polyvinyl alcohol polymer located in heavier concentration near the surface of said paper with a polyolefin coating provided on at least one surface, a hydrophilic colloid layer on the polyolefin coating and a light sensitive silver halide emulsion on the hydrophilic colloid layer, said hydrophilic colloid layer comprising from about 20 to 80 percent by weight of a white pigment, and from about 15 to 35 percent by weight of hollow microspheres having a diameter of from about 0.1 to about 1 μm.

23 Claims, 4 Drawing Sheets

FIG. 2
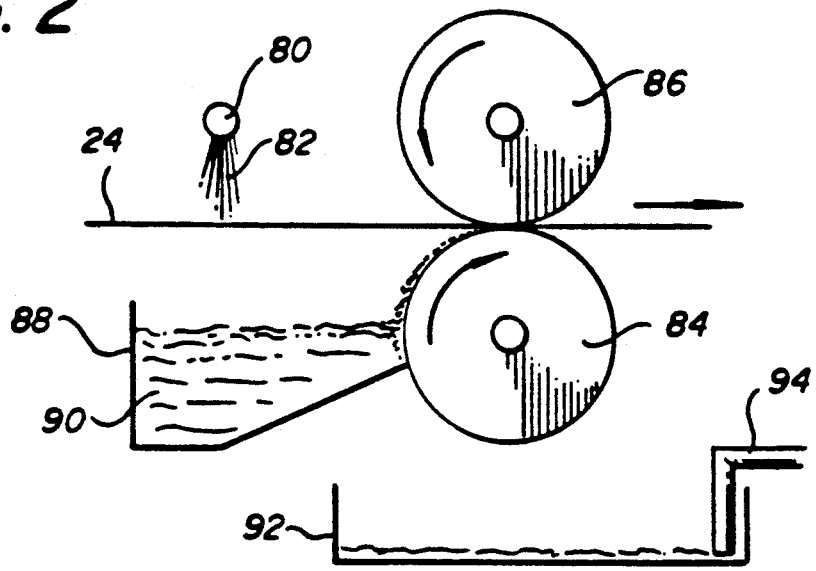
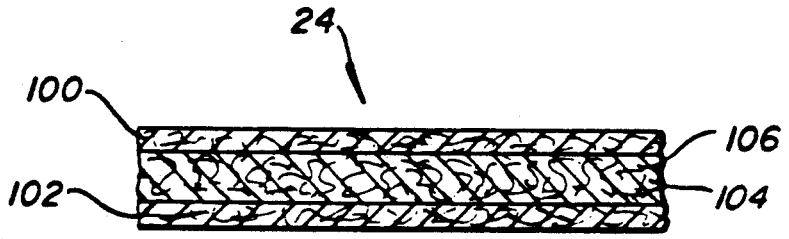
FIG. 3
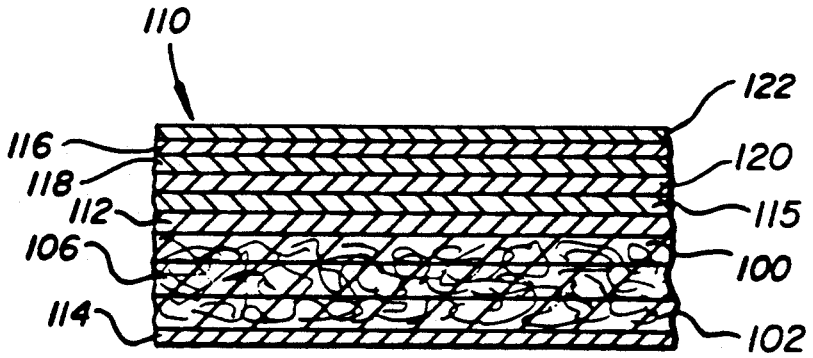
FIG. 4

PHOTOGRAPHIC PAPER SUPPORT WITH SILVER HALIDE EMULSION LAYER

TECHNICAL FIELD

This invention relates to photographic paper and more particularly to photographic paper that exhibits improved opacity, reflectance, curl resistance, image stability, and image sharpness characteristics.

BACKGROUND ART

It has been heretofore known to apply polyolefin layers to both surfaces of paper prepared for photographic purposes. In many cases, the polyolefin layer which is between the paper support and the light sensitive photographic emulsion has pigments added thereto, such as, titanium dioxide in order to render the polyolefin layer white in appearance. This also increases the reflectivity of the polyolefin surface and improves the quality of the resulting photograph. A problem that exists with such substrates employed in the photographic art is that the sharpness of the resulting image formed in the light sensitive layers is not as high as is desirable when very high quality images are needed, for example, in professional applications. This is generally true because it is not possible to include sufficiently high percentages of pigment material in the polyolefin coatings to achieve the opacity and reflectivity necessary for high sharpness quality images.

In order to overcome this problem, the prior art suggests that a layer of gelatin containing titanium dioxide particles be interposed between one of the polyolefin layers and the light sensitive photographic emulsion. British Patent Specification No. 1,551,258 suggests a photographic paper coated on both sides with polyethylene and coated on one polyethylene surface with a mixture of gelatin, colloidal silica, and particles of titanium dioxide, baryta or (non-colloidal) silica having an average particle size within the range of 0.1 to 5 microns and optionally an anionic surface active agent U.S. Pat. No. 4,558,002, issued Dec. 10, 1985, teaches a photographic paper having such a structure wherein the layer intermediate to the polyolefin layer and the light sensitive layer is a hydrophilic colloid layer containing a dye or pigment that is not decolored during photographic processing and a white pigment present in the hydrophilic colloid layer in an amount not less than 30% by volume.

U.S. Pat. No. 4,755,454 suggests a structure similar to the two preceding discussed references wherein the hydrophilic colloid layer contains a white pigment present in an amount of at least 68 percent by weight.

In formation of photographic materials, there is a continuing desire for such materials to remain uniform over time both prior to exposure and after exposure and development. It is particularly desirable in photographic papers that photographs remain stable when displayed. In order to accomplish this, there has been a continued desire for more stable colors. There has also been a desire to provide increased stability to present color photographs by treating the supports for the images. Such treatments prevent transmission of gases that would react with colorants. Placing overcoats over the images also prevents transmission of oxygen that would react with the colorants of photographs.

It is disclosed in U.S. Pat. No. 4,861,696 —Tamagawa et al that the wood pulp of a paper may be partially replaced with a synthetic pulp to lower the oxygen permeability. U.S. Pat. No. 3,364,028—Konig discloses prevention of yellow fog formation by coating a baryta layer.

U.S. Pat. No. 4,283,496—Aono et al discloses the formation of a photographic layer having a single layer of polyvinyl alcohol polymer or other polymer that lowers oxygen transmission through said paper.

U.S. Pat. No. 3,582,337—Griggs et al and U.S. Pat. No. 3,582,339 —Martens et al disclose various protective layers for photographic papers.

U.S. Pat. No. 2,358,056 —Clark discloses a photographic paper having a layer of barium sulfate dispersed in polyvinyl alcohol between the photographic emulsion and the paper.

U.S. Pat. No. 3,277,041 —Sieg et al discloses the use of a cross-linked polyvinyl alcohol polymer to increase the water resistance of a photographic paper.

While the life of photographic images has increased, there still remains a need for improvement in stability of photographic images. It is particularly desirable that an increase in the photographic image life be obtained without necessity to reformulate color image couplers which have been balanced for pleasing color rendition and acceptable sensitometric performance. There is also a need for photographic papers that do not exhibit curl.

THE INVENTION

It is an object of the invention to overcome disadvantages of prior photographic papers and photographic elements.

It is another object to form papers having improved curl resistance.

It is an object of the invention to provide photographic paper having increased light image stability and image sharpness.

It is another object of the invention to produce photographs having a more neutral fade and, therefore, a longer useful life.

DISCLOSURE OF INVENTION

The present invention provides a photographic element having a paper substrate with a polyolefin film provided on at least one surface thereof, a hydrophilic colloid layer on the polyolefin film and at least one light sensitive silver halide emulsion layer on the hydrophilic colloid layer, the hydrophilic colloid layer having incorporated therein from about 20 to about 80 percent by weight of a white pigment and from about 15 to about 35 percent by weight of hollow microspheres having an average diameter of from about 0.2 to about 2.0 micrometers. The products in accordance with this invention demonstrate improved opacity and reflective characteristics and improved sharpness.

The invention, in addition to the improved hydrophilic layer, also utilizes a paper sheet or substrate that contains between about 4 and about 6 percent by weight of polyvinyl alcohol that is concentrated near the surface of said paper. Further, the paper has an oxygen leak rate of less than about 25 $cc/m^2/day$ and an oxygen gas transmission rate of less than about 1 $cc/m^2/day$.

BRIEF DESCRIPTION OF DRAWINGS

FIG. 2 illustrates an alternate apparatus and method for applying polyvinyl alcohol to the paper.

FIG. 3 is a cross section of a paper substrate of the invention.

FIG. 4 is a cross section of a photographic element of the invention.

MODES FOR CARRYING OUT THE INVENTION

Figure 1A:
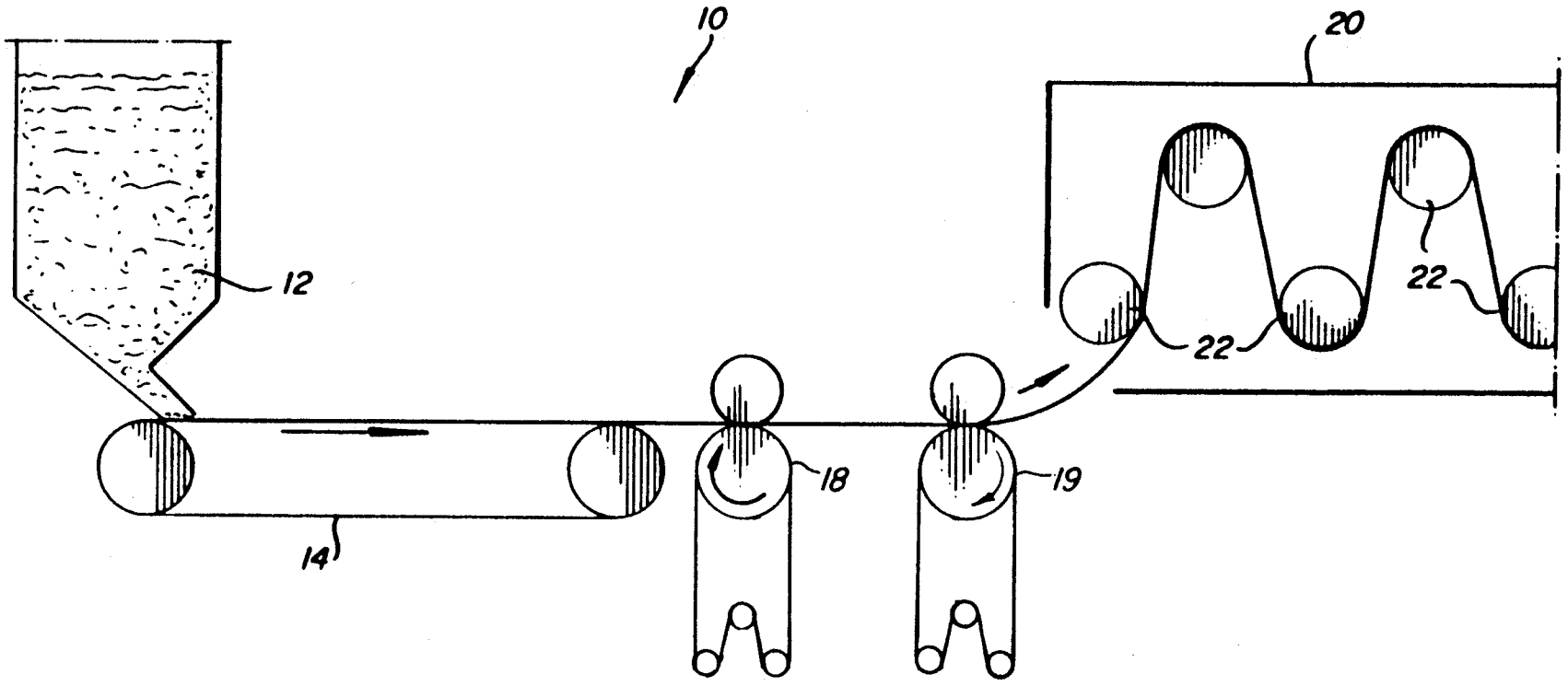
FIGS. 1A, 1B, and 1C illustrate schematically the apparatus and method of the invention.

The invention has numerous stability, sharpness, and curl resistance advantages over prior processes and products. The process allows the impregnation of sufficient polyvinyl alcohol polymer to reduce oxygen transmission without interfering with the coating of the normal polyethylene layer that serves as a base for the photosensitive emulsion layers on the photographic paper. Further, the process of the invention allows formation of a photographic element that has improved image sharpness and image stability without a change in the image-forming materials. Further, the photographic elements of the invention have the advantage that the photographic paper may be formed utilizing substantially the current paper formation process, with the addition of the polyvinyl alcohol polymer solution application apparatus. These and other advantages will be apparent from a detailed description of the invention below.

The invention provides a polyolefin coated polyvinylalcohol polymer impregnated photographic paper having improved sharpness wherein on the free surface of a polyolefin layer a hydrophilic colloid layer is coated, the hydrophilic colloid layer containing from about 20 to about 80 percent by weight of a white pigment and from about 15 to about 35 percent by weight of hollow microspheres having a mean diameter of from about 0.2 to about 2 μm. Any suitable white pigment may be used, such as, for example, barium sulfate, zinc oxide, barium stearate, silver flakes, silicates, alumina, calcium carbonate, antimony trioxide, zirconium oxide, zirconium acetyl acetate, sodium zirconium sulfate, kaolin, mica, titanium dioxide and the like. The anatase and rutile crystalline forms of titanium dioxide are preferred. The anatase form is most preferred because of its whiteness. The white pigment should preferably have an average particle size of from about 0.1 to about 1.0 μm and most preferably from about 0.2 to about 0.5 μm.

As indicated above. the hydrophilic colloid layer also contains from about 15 to about 35 percent by weight of hollow microspheres having a mean diameter less than 2 micrometers preferably from about 0.1 to about 1 micrometer and most preferably from about 0.25 to about 0.8 micrometer. The microspheres are hollow or air containing microcapsular particles having polymeric walls. Any suitable polymeric material may be employed, such as, for example, polyvinyl chloride, polystyrene, polyvinyl acetate, vinyl chloride-vinylidene chloride copolymers, cellulose acetate, ethyl cellulose, novalac resins having a linear polymeric configuration, acrylic resins, such as for example, polymethylmethacrylate, polyacrylamide, and the like, copolymers of any suitable combination of ethylenically unsaturated monomers including those specifically mentioned above and the like. Particularly suitable microspheres for use in accordance with this invention are those formed from a copolymer of styrene and acrylic acid and sold by Rohm and Haas Company under the trade designation ROPAQUE OP-42, OP-62 and OP-84. The hollow microcapsules taught in U.S. Pat. Nos. 3,418,250; 3,418,656; 3,585,149; and 3,669,899 all of which are fully incorporated herein by reference are applicable for use in accordance with this invention.

Any suitable hydrophilic colloid may be employed in the practice of this invention such as, for example, both naturally occurring substances, such as, proteins, derivatives thereof, cellulose derivatives, such as, cellulose esters, gelatin including alkali treated gelatin or acid treated gelatin, gelatin derivatives, and any of the hydrophilic materials described in *Research Disclosure* 308119, paragraph IX, published December, 1989. A mixture of any of these materials may also be used if desired. Preferably the hydrophilic colloid is deionized gelatin which may be acid or alkali processed. The hydrophilic colloid material is employed as a binder for the various ingredients in an amount of from about 5 to about 50 percent by weight based on the total weight of the layer, preferably from about 8 to about 35 percent and most preferably from about 10 to about 25 percent.

In addition to the white pigment and the hollow microspheres, the hydrophilic colloid layer may contain additional addenda in order to optimize the appearance and reflectivity of the layer and the photographic print when utilized in accordance with this invention, such as, for example, optical brighteners, uv absorbers, biocides, various coloring agents, such as dyes or pigments as disclosed in U.S. Pat. No. 4,558,002 (incorporated herein by reference).

Suitable optical brightening agents such as, thiophenes, stilbenes, triazines, imidozolones, pyrazolines, triazoles, coumarins, oxazoles, oxadiazoles, acetylenes, vinylenes, and the like as set forth in *Research Disclosure* Volume 308 , December, 1989, page 998, paragraph V, and U.S. Pat. No. 4,794,071 (both fully incorporated herein by reference). Particularly preferred optical brightening agents are hydrophobic brighteners incorporated into the hydrophilic colloid layer in the form of a loaded latex as taught in U.S. Pat. Nos. 4,203,716 and 4,584,255. The optical brightening agent may be imbided on to the hollow microspheres and incorporated in to the hydrophilic colloid in this matter rather than employing a separate latex unto which the optical brightener is loaded.

Suitable biocides include, for example, phenol, thymol, polychlorphenols, cresol, p-chlorocresol, benzylphenol, halophens, 2,2'-dihydroxy-5,5'-dichlorodiphenyl, sorbic acid, amines, such as, hexamethyltetramine, disulfides, mercapto compounds, imidazols, mercury compound antibiotics, benzoisothiazole, isothiazolinones and other materials set forth in U.S. Pat. Nos. 4,224,403 and 4,490,462 both of which are incorporated herein by reference.

Suitable ultraviolet absorbers include aryl substituted benzotriazole compounds, 4-thiazolidone compounds, benzophenone compounds, cinnamic acid ester compounds, butadiene compounds, benzooxazole compounds and other uv absorbers as set forth in *Research Disclosure*, Vol. 308, December 1989, page 1003, paragraph VIII (incorporated herein by reference).

The various ingredients to be employed in the hydrophilic colloid layer in accordance with this invention are formulated into a suitable coating composition for the deposition of the layer by any suitable technique. In addition to the various ingredients, dispersing aids are employed in order to obtain suitable and uniform distribution of the white pigment and hollow microspheres throughout the layer. Suitable dispersing aids include those set forth, for example, in U.S. Pat. Nos. 3,288,846;

3,298,956; 3,214,454; 3,234,124; 3,567,768; and 3,796,749.

In a preferred method of preparing the coating composition for forming the hydrophilic colloid layer the white pigment, dispersing agents and biocide if one is to be used, are intimately mixed in water in a media mill, Cowles dissolver or other suitable high shear apparatus. This pigment dispersion is next mixed with the remainder of the components including the microspheres, the optical brightener, tinting aids, and the like, and then added to the gelatin which has been previously melted.

The dispersing aid or aids are generally present in an amount of from about 0.05 to 2 and preferably from about 0.05 to about 0.5 percent by weight based on the dry ingredients present. The coating composition is then applied by any suitable coating technique on appropriate coating equipment to the surface of the polyolefin layer which has been coated onto the surface of the raw polyvinyl alcohol impregnated paper stock in accordance with the commonly accepted practice in the photographic paper industry. The paper stock generally and preferably contains layers of polyolefin on both sides of the paper stock. In many instances, different types of polyolefin will be applied to either surface in order to aid in curl control of the paper.

After application of the polyolefin to the paper stock, the surface of the polyolefin layer, which is to receive the hydrophilic colloid layer and ultimately the light sensitive layer or layers, is treated with a corona discharge in order to improve the adhesion of subsequent layers. The various layers that form the structure in accordance with this invention may have interposed therebetween subbing layers, widely known in the art, to also improve adhesion between adjacent layers. Onto the corona discharge treated surface of the polyethylene is deposited a hydrophilic colloid layer in accordance with this invention. A particularly suitable coating composition for deposition of the hydrophilic colloid layer includes a water dispersion of about 10 to 20 parts by weight of anatase titanium dioxide, a particularly preferred material being a product sold under the trade designation UNITANE 0-310 by Kemira Inc., Savanna, Ga., about 0.015 to about 0.045 of a suitable dispersing aid to uniformly aid in the distribution of the solid particles in the dispersion, a particularly useful dispersing aid is a mixture of sodium salt of a polycarboxylic acid sold under the trade designation DISPEX N-40 by Allied Colloids and tetrasodium pyrophosphate, which is sold under the trade designation TSPP by FMC; about 0.001 to about 0.0025 parts of a suitable biostatic agent, a particularly suitable material is one sold under the trade designation Ottasept by Ferro Corp. from about 3 to about 5 parts by weight of gelatin, from about 6.5 to about 8 parts of hollow microspheres a particularly suitable material is one sold under the trade designation ROPAQUE OP-84 by the Rohm & Haas Company; from about 0.04 to about 0.07 parts of an optical brightener, a particularly suitable material is one sold under the trade designation UVITEX-OB by Ciba-Geigy and having the formula:

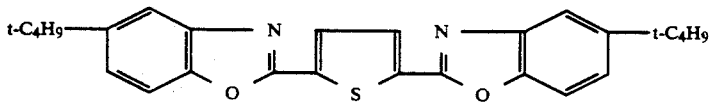

about 0.001 to about 0.003 parts of a combination of cyan and magenta tinting pigments sold under the trade designation TINT-AYD WD-2018 by Daniel Products Company and the balance of water in order to make 100 parts by weight of coating composition. With regard to the optical brightening agent, it is preferred that this material be added to the dispersion in the form of a loaded latex by being incorporated into the latex in accordance with U.S. Pat. Nos. 4,203,716 or 4,584,255, both incorporated herein by reference. In this regard, the latex is one prepared by an emulsion polymerization technique wherein styrene and divinyl benzene are copolymerized. The latex is employed in an amount from about 2.5 to about 3.5 parts in the formulation set forth. This composition is coated onto the corona discharge treated polyolefin surface in a coverage of at least about 500 milligrams/ft$^2$ (5.4 g/m$^2$) preferably from about 500 mg/ft$^2$ and to about 1500 mg/ft$^2$ (16.2 g/m$^2$), and most preferably from about 700 mg/ft$^2$ (7.5 g/m$^2$) to about 1000 mg/ft$^2$ (10.9 g/m$^2$).

Finally, at least one silver halide emulsion layer is built on the free surface of the hydrophilic colloid layer. Any of the known silver halide emulsion layers, such as those described in *Research Disclosure,* Volume 176, December 1978, Item 17643 and *Research Disclosure,* Volume 225, January 1983, Item 22534, the disclosures of which are hereby incorporated by reference in their entirety, are useful in preparing photographic elements in accordance with this invention. Generally, the photographic element is prepared by coating the support with one or more layers comprising a dispersion of silver halide crystals in an aqueous solution of gelatin, and optionally one or more subbing layers, etc. The coating process is generally carried out on a continuously operating machine wherein a single layer or a plurality of layers are applied to the support. For multi-layer elements, layers are generally coated simultaneously on the support as described in U.S. Pat. Nos. 2,761,791 and 3,508,947.

Figure 1B:
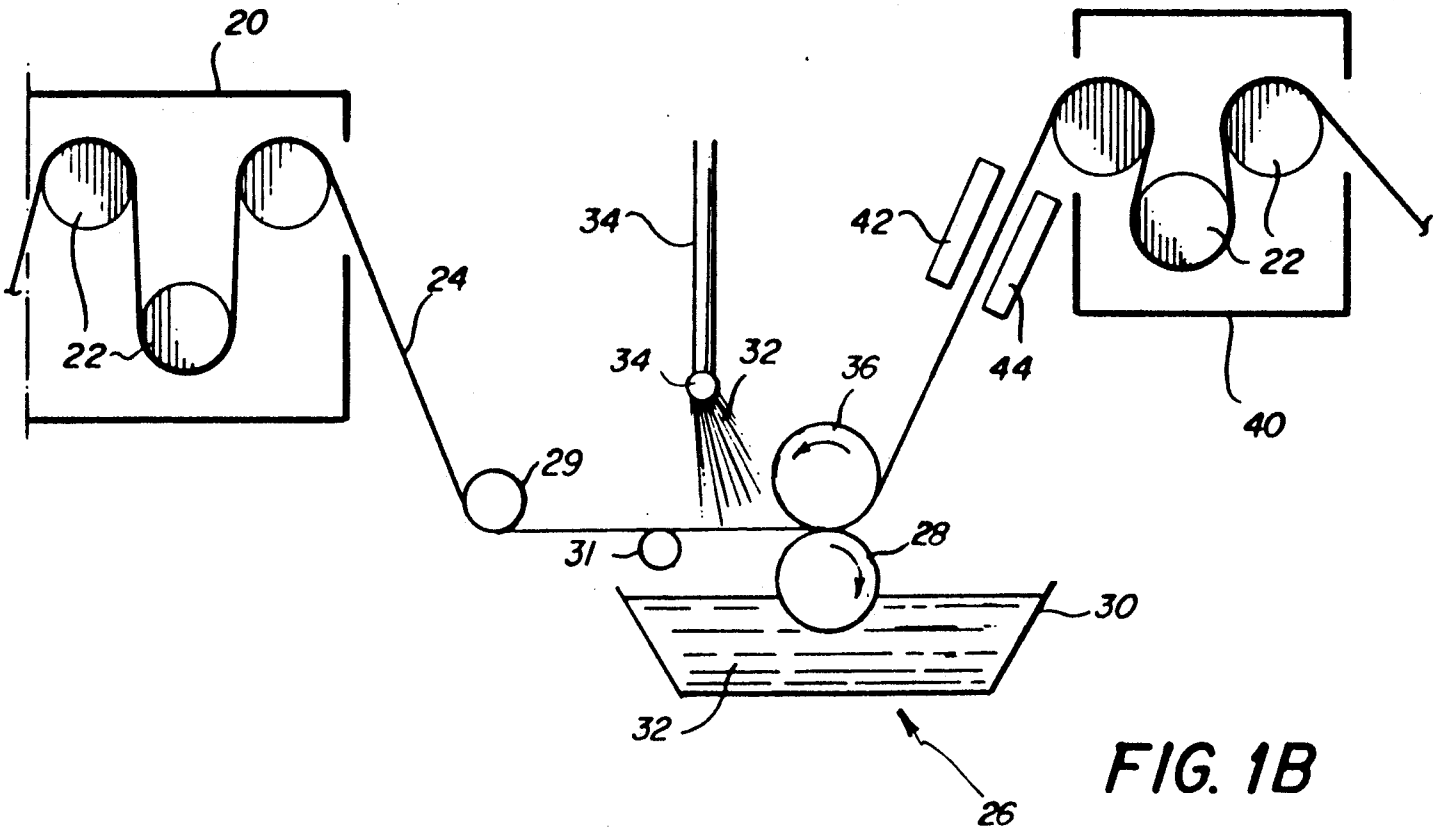
Figure 1C:
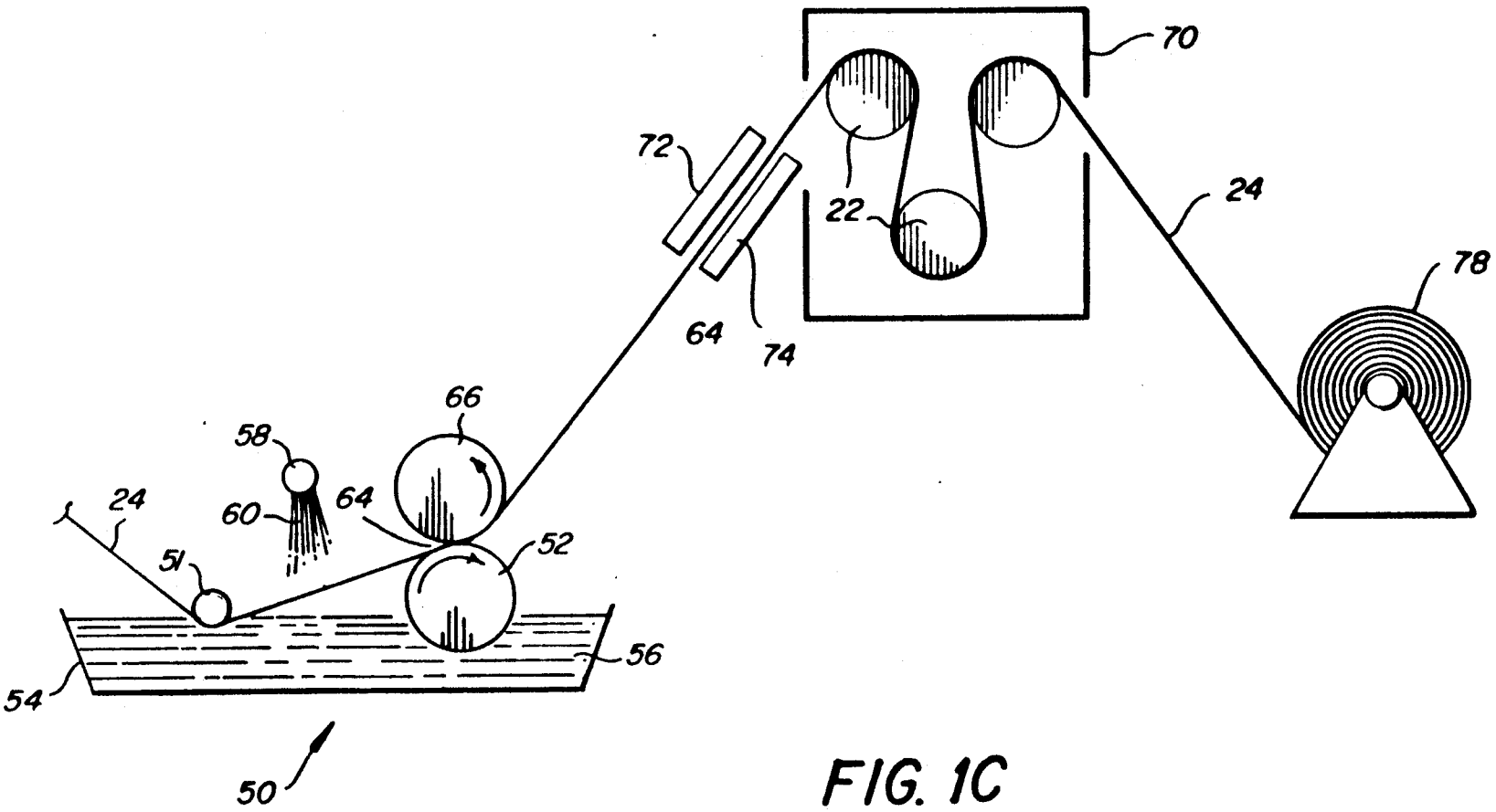

Illustrated schematically in FIG. 1A is a Fourdrinier paper-making machine 10 where a mixture of wood pulp and water is applied from head box 12 onto the wire belt 14. From the Fourdrinier paper-making machine, the paper as is conventional goes to the wet presses 18 and 19 and then into dryer 20 containing a series of heater drums 22, it being noted, that in a paper-making machine there would be a multiplicity of heated dryer drums 22, whereas in the drawing only a few are shown at each drying stage. After exiting the first dryers 20, as shown in FIG. 1B, the paper 24 passes into the first polyvinyl alcohol sizing apparatus 26 comprising roller or drum 28 and tank 30 containing the polyvinyl alcohol solution 32. The paper 24 has polyvinyl alcohol applied to the lower side by roller or drum 28 rotating in polyvinyl alcohol solution 32. Prior to entering the nip between rollers 28 and 36, the paper 24 passes turning roller 29 and support roller 31. The paper 24 also has polyvinyl alcohol solution applied to the upper surface by spray 32 from the perforated pipe 34. The nip of rollers 36 and 28 serves to aid in impregnation of polyvinyl alcohol into the paper 24 and also prevent excess polyvinyl alcohol polymer on the surface of the paper from being carried to the second dryer 40. Prior to entering the second dryer 40, the paper may optionally be subjected to non-contact dryers 42 and 44 that may be radiant or hot air dryers. Dryer 40 also contains a series of dryer drums 22. Radiant heaters 42 and 44, if used, serve to reduce the tendency for any polyvinyl alcohol solution on the surface to attach itself to the dryer drums and causing pits or scabs in the paper. After exiting from dryer 40, the paper having been once impregnated and passing through the second stage dryer 40 then enters, as illustrated in FIG. 1C, the second polyvinyl alcohol sizing apparatus 50 comprising rollers 51 and 52 and tub 54 containing the polyvinyl alcohol solution 56. This sizing station 50 is also provided with the perforated pipe 58 spraying polyvinyl alcohol solution 60 onto the upper surface of paper 24. Rolls 52 and 66 by pressure in the nip 64 serve to aid in impregnation of the polyvinyl alcohol into the paper, as well as prevent excess surface material from reaching the third stage dryer 70. It is most preferred that non-contact dryers 72 and 74 be utilized prior to the third stage drying in order to dry the surface to prevent adhesion of polyvinyl alcohol to dryer drums 22. It is also possible to utilize dryer drums with a release surface such as the fluorine substituted hydrocarbons (i.e., polytetrafluoride) to aid in polyvinyl alcohol release from the surface of the dry drum. After exiting third stage dryer 70, the impregnated substantially oxygen impermeable paper is normally calendered, by means not shown, and then wound up on roll 78.

Illustrated in FIG. 2 is an alternate means of polyvinyl alcohol impregnation. As illustrated in FIG. 2, the paper 24 passes below a perforated pipe applicator 80 dispensing polyvinyl alcohol solution spray 82 onto the upper surface of the paper. The lower surface of the paper has polyvinyl alcohol solution applied to it by roll 84 operating in opposition to roll 86. Roll 84 passes by hopper 88 that is filled with polyvinyl alcohol solution 90 which is applied to roll 84. Overflow from roll 84 is collected in pan 92 for removal and recycling by pipe 94. This alternate application system may be substituted for either first stage sizing 26 or second stage sizing 50 as illustrated in the FIG. 1 drawings.

The polyvinyl alcohol impregnated paper substrate of the invention has a higher concentration of polyvinyl alcohol polymer nearer the surface of the paper as illustrated by the cross section of FIG. 3 where areas 100 and 102 near the surface of the paper have a greater polymer load than the center area 106. Wood fibers 104 are relatively evenly distributed throughout the paper. Illustrated in FIG. 4 is a photographic element 110 of the invention formed utilizing the polyvinyl alcohol impregnated photographic paper. The paper as illustrated has the conventional polyethylene layers 112 and 114 on each side of the paper. The hydrophilic colloid layer 115 is between the polyethylene layer 112 and the first light sensitive layer 120. The photographic paper also contains a blue light sensitive layer 116, a green light sensitive layer 118, and a red light sensitive layer 120. The photographic element 110 is further provided with a protective surface layer 122, typically of gelatin. Ultraviolet light absorbers in the surface layer or below the surface cyan layer normally are utilized.

The polyvinyl alcohol utilized in the impregnation of the invention may be any polyvinyl alcohol that results in a substantially impermeable to oxygen paper. Polyvinyl alcohol is formed by hydrolysis of vinyl acetate. Polyvinyl alcohol prior to use is soluble in water and available in powder or pellet form. The more fully hydrolyzed polyvinyl alcohols have higher water and humidity resistance. The molecular weight average may vary between above 13,000 and up to 200,000. The higher molecular weight materials have increased water resistance, adhesive strength, and viscosity. A preferred material has been found to be a medium molecular weight polyvinyl alcohol of about 99 percent hydrolysis, as this material provides reduced oxygen permeability of the paper.

The polyvinyl alcohol polymer is impregnated in any amount that provides substantial oxygen impermeability. Generally it is preferred that the pickup range be between about 4 and about 11 weight percent of the dry paper weight for an effective barrier to oxygen infiltration and relatively low cost. A pick-up of about 4 to 6 weight percent is preferred for low cost with good oxygen permeability properties. The impregnation of the invention results in a paper that does not have a polyvinyl alcohol layer above the surface but has polyvinyl alcohol concentrated near both surfaces of the paper. It has been found that the process of the invention with two applications or passes of the paper in polyvinyl alcohol solution with drying after each pass results in sufficient pick-up of polyvinyl alcohol to provide the oxygen impermeability desired. Generally the range of polyvinyl alcohol in the solution is between about 8 and about 12 weight percent with a preferred amount being about 9 to about 11 weight percent for adequate impregnation of the paper. The PVA sizing solution also generally contains up to 1 percent sodium chloride based on the PVA solids. The sodium chloride provides internal conductivity to the paper such that it is not susceptible to static electricity buildup. A preferred solution viscosity of the polyvinyl alcohol impregnation solution is between about 250 and about 350 centipoise at 120° F.

The sizing operation also may apply fillers, pigment, brighteners, dyes, hardeners, and other addenda typically utilized in size solutions.

The non-contact drying immediately after polyvinyl alcohol impregnation serves to dry the surface of the paper to be non-tacky such that contact with the dryer drums does not cause adhesion of wet polymer to the dryer drums. Further, the non-contact drying serves to aid in concentration of polyvinyl alcohol nearer the surface of the paper such that oxygen impermeability results with less use of polyvinyl alcohol. The non-contact drying preferably removes at least about onethird of the water in the support.

It is preferred that the paper prior to any impregnation with polyvinyl alcohol be dried to below about 10 percent moisture and preferably below about 5 percent moisture for greater polyvinyl alcohol pick-up when dipped into the polyvinyl alcohol solution. Prior to the second station for polyvinyl alcohol application, it is preferred that water content be below about 5 percent and most preferably below about 3 percent for low variability in polyvinyl alcohol pick-up. It is particularly desirable that non-contact drying be carried out after the second polyvinyl alcohol solution application to the sheet, as there is a greater tendency for the polyvinyl alcohol solution at the surface to stick to the drying drums if it is tacky upon contact with them.

Generally the paper sheet that is impregnated with the polyvinyl alcohol may be of any desired basis weight. It is generally preferred that the paper sheet have a basis weight of between about 25 and about 50 lbs/1000 sq. ft to provide a conventional feel and handling to the impregnated paper. A heavier weight paper of up to 80 lbs/1000 sq. ft. may be preferred for display purposes.

The polyvinyl alcohol impregnated papers can be utilized in the formation of photographic elements which, after exposing and processing, generate colored images which are surprisingly stable to light. Furthermore, the images exhibit neutral fade to light; the yellow, magenta, and cyan image dyes fade at the same rate, thus prolonging the useful lifetime of the print. In a typical color print, the light stabilities of the yellow and magenta image dyes are usually inferior to the light stability of the cyan image dye leading to an objectionable non-neutral fade of the color print. For color prints formed from impregnated papers described in this invention, however, the light stabilities of the yellow and magenta image dyes are improved substantially, while the light stability of the cyan image dye remains largely unaffected leading to greater image stability and neutral color fade. The yellow and magenta image dyes which benefit from the impregnated supports are formed by the reaction of oxidized color development agents with 2-and 4-equivalent image couplers such as open-chain ketomethylenes, pyrazolones, pyrazolotriazoles, and pyrazolobenzimidazoles. Typically, such image couplers are ballasted for incorporation in high boiling coupler solvents.

Couplers which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; 2,908,573, and "Farbkuppler-eine Literaturubersicht," published in Agfa Mitteilungen, Band III, pp. 126–156 (1961).

Couplers which form yellow dyes upon reaction with oxidized color developing agents are described in such representative patents and publications as: U.S. Pat. Nos. 2,875,057; 2,407,210; 3,265,506; 2,298,443; 3,048,194; 3,447,928; 5,021,333, and "Farbkuppler-eine Literaturubersicht," published in Agfa Mitteilungen, Band III, pp. 112–126.

In addition, other image couplers which can be useful are described in the patents listed in *Research Disclosure,* December, 1989, Item No. 308119, paragraph VII D, the disclosure of which is incorporated herein by reference. Preferred couplers for elements of the invention are:

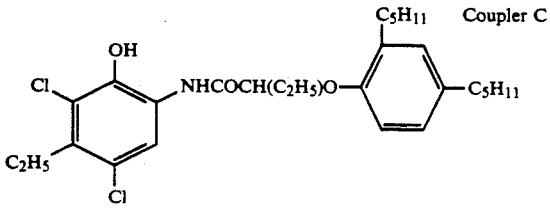

-continued

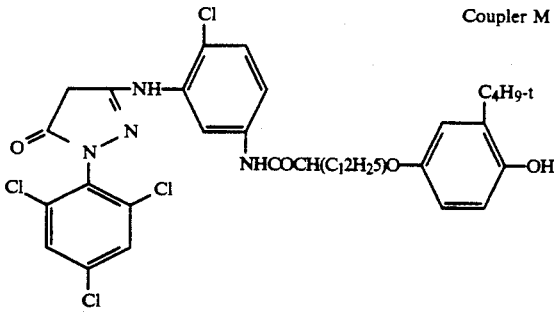

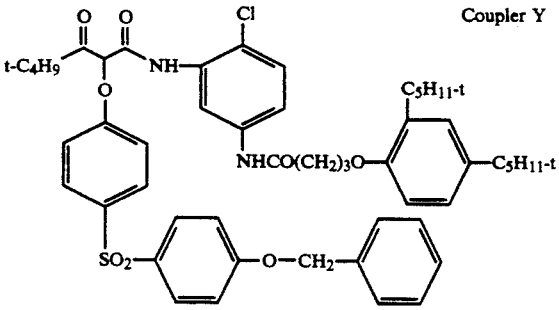

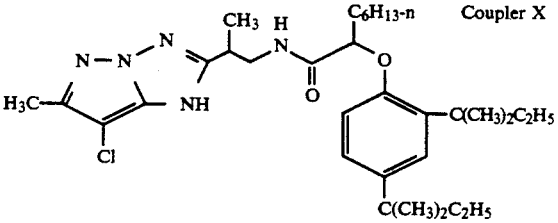

Another key element to enhancing the useful lifetime of a color print is the reduction or elimination of the yellow stain which can form on prolonged exposure to light. This can be accomplished by coating a sufficient quantity of an ultraviolet light absorber (UVA) in the photographic element. Typically the UVA's are substituted phenylbenzotriazoles which are described in such representative patents as U.S. Pat. Nos. 4,853,471; 4,790,959; 4,752,298; 4,973,701; 4,383,863; 4,447,511; and references listed therein. Specific UVA's described in this invention are shown in structures:

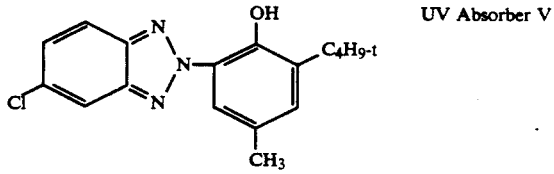

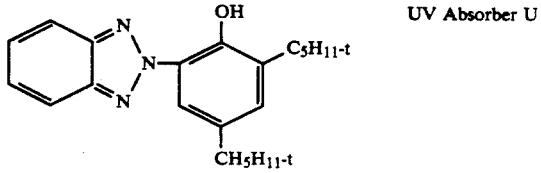

Preferred UV absorbers are the liquid type to minimize crystallization and surface blooming problems observed with solid UVA's. A typical liquid UV is

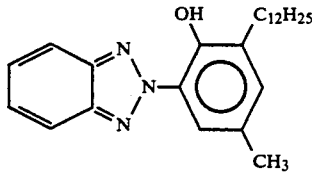

UV Absorber R

Various layers to convert the paper support into a light reflecting print material, such as silver halide emulsion layers, subbing layers, interlayers, and overcoat layers are provided onto the paper support of the invention. Also conventional polyethylene extrusion coated layers may be provided on the paper support. The silver halide emulsion employed in the elements of this invention can be either negative-working or positive-working. Suitable emulsions and their preparation are described in sections I and II of the *Research Disclosure,* December, 1978, Item No. 17643, published by Industrial Opportunities, Ltd., The Old Harbourmaster's, 8 North Street, Emsworth, Hants, P010 7DD, England. The silver halide emulsions employed in the present invention preferably comprise silver chloride grains which are at least 80 mole percent silver chloride and the remainder silver bromide.

The following examples are intended to be illustrative and not exhaustive of the invention. Parts and percentages are by weight unless otherwise indicated.

The invention will be further illustrated by the following examples:

EXAMPLE 1

CONTROL

A high quality conventional color paper substrate having a thickness of 178 μm and a basis weight of 185 g/m$^2$ was laminated on one surface with clear medium density polyethylene in a thickness of 30 μm (29 g/m$^2$) and on the opposite surface with a low density polyethylene containing 12.5% $TiO^2$ and 0.05% of a mixture of bis(benzoxyazolyl) stilbene optical brighteners described in U.S. Pat. No. 4,794,071 in a thickness of 28 μm (27 g/m$^2$) to prepare a support. The medium density polyethylene resin coat was subjected to a coronadischarge treatment and coated with an antistat in the amount of 0.17–0.47 g/m$^2$ dry weight. The seven gelatin layers described below are coated on the polyolefin surface of the above described support, various components being deposited in the following coverage to provide a light sensitive photographic material:

The seven gelatin layers are as follows, layer 1 being adjacent to the hydrophilic colloid layer:

Layer 1: Blue Sensitive Layer

Chemically and blue spectrally sensitized monodisperse silver chloride negative emulsion (0.34 g Ag/m$^2$) and yellow-dye forming coupler Y (1.08 g/m$^2$) in di-n-butyl phthalate coupler solvent (0.27 g/m$^2$), gelatin (1.51 g/m$^2$)

Layer 2: Interlayer

Gelatin (0.75 g/m$^2$)

0.94 g/m$^2$-1,4-dihydroxybenzene (oxidized developer scavenger)

Layer 3: Green Sensitive Layer

Chemically and green spectrally sensitized monodisperse silver chloride negative emulsion (0.33 g Ag/m$^2$) and magenta-dye forming coupler M (0.42 g/m$^2$) in di-n-butyl phthalate coupler solvent (0.22 g/m$^2$), gelatin 1.2 g/m$^2$)

Layer 4: UV Absorbing Interlayer

A mixture of hydroxyphenylbenzotriazoles (0.38 g/m$^2$), gelatin (0.76 g/m$^2$)

Layer 5: Red Sensitive Layer

Chemically and red spectrally sensitized monodisperse silver chloride negative emulsion (0.31 g Ag/m$^2$-)and cyan-dye forming coupler C (0.42 g/m$^2$) in di-n-butyl phthalate coupler solvent (0.24 g/m$^2$), gelatin (1.08 g/m$^2$)

Layer 6: UV Absorbing Layer

A mixture of hydroxyphenylbenzotriazoles (0.38 g/m$^2$), gelatin (0.76 g/m$^2$)

Layer 7: Overcoat Layer

Gelatin (1.35 g/m$^2$)

The layers 1 to 6 were hardened with bis(vinylsulfonyl)methyl ether at 1.8% of the total gelatin weight. Coupler identifications are:

C=Cyan dye forming coupler: 2-(α-(2,4-di-tert-amyl-phenoxy) butyramido)-4,6-dichloro-5-ethyl phenol M=Magenta dye forming coupler: 1-(2,4,6-trichlorophenyl)-3-(2-chloro-5(α-(4-hydroxy-3-tert-butylphenoxy)-tetradecanoamido) anilino)-5-pyrazolone Y=Yellow dye forming coupler: α-(4-(4-benzyloxyphenyl-sulfonyl) phenoxy)-α-(pivalyl)-2-chloro-5-(γ-(2,4-di-t-amylphenoxy) butyramido)acetanilide This sample was exposed stepwise to blue, green, and red light and then developed in a three-step process of color development (45 seconds at 95° F.), bleach-fix (45 seconds at 95° F.), and washing (90 seconds at 91°–94° F.), followed by drying (60 seconds) at 60° C.

The formulations for the above processing solutions are as follows:

| | |
|---|---|
| (1) Color developer | |
| Lithium salt of sulfonated polystyrene (30% by wt) | 0.23 g |
| Triethanolamine | 8.69 g |
| N,N-diethylhydroxylamine (85% by wt) | 5.04 g |
| Potassium sulfite | 0.24 g |
| Color developing agent 4-(N-ethyl-N-2-methanesulfonylaminoethyl)-2-methylphenylenediamine-sesquisulfate monohydrate | 5.17 g |
| Blankophor REU, 133% | 2.1 g |
| Lithium sulfate | 1.83 g |
| Potassium chloride | 1.6 g |
| Potassium bromide | 10 mg |
| 1-hydroxyethyl-1,1-diphosphonic acid | 0.81 g |
| Potassium bicarbonate | 3.59 g |
| Potassium carbonate | 20.0 g |
| Water to total of 1 liter, pH adjusted at 80° F. to 9.98. | |
| (2) Bleach-fix | |
| Ammonium thiosulfate | 127.4 g |
| Sodium metabisulfite | 10 g |
| Ethylenediaminetetraacetic acid ferric ammonium salt | 110.4 g |
| Glacial Acetic acid | 10.2 g |
| Water to total 1 liter, pH adjusted at 80° F. to 5.5. | |

EXAMPLE 2

CONTROL

The article forming process of Example 1is repeated except a layer of 3.5 gm/m$^2$ polyvinyl alcohol was coated between the paper and medium density RC polyethylene coating. The PVA used is Airvol 125 (Manufacturer: Air Products). Airvol 125 is a super hydrolyzed grade (99.3+%) PVA with a viscosity of 26–30 cps at a 4% concentration and 20° C. Coating to the support was made using an X-hopper at 200 ft/min.

EXAMPLE 3

CONTROL

The article and process of Example 1 is repeated except a white pigment layer is placed between the resin coated paper of Example 1 and the emulsion layers. The pigment layer is formed as set forth below.

An aqueous white pigment containing formula having a composition as described in Table I was prepared in the following manner:

TABLE I

Hydrophilic Colloid Coating Formula

| Ingredient | Dry Wt (Kg) | Wet Wt (Kg) |
|---|---|---|
| 1 $TiO_2$ dispersion | 14.39 | 20.56 |
| 2 Distilled Water | — | 12.27 |
| 3 Optical Brightener[a] | 3.14 | 9.84 |
| 4 Ropaque OP-84[b] | 7.2 | 17.99 |
| 5 Tint Ayd WD 2018[c] | 0.0019 | 0.086 |
| 6 Gelatin[d] | 3.93 | 39.25 |

[a]Uvitex loaded styrene/divinyl benzene latex described in U.S. Pat. No. 4,584,255
[b]Styrene/acrylic polymer, sold by Rohm and Haas Co.
[c]Light fast cyan and magenta pigment dispersion, sold by Daniel Products Co.
[d]Deionized gelatin

Preparation of TiO$^2$ Dispersion

To 39.47 Kg of distilled water was added with stirring 0.108 Kg of tetrasodium pyrophosphate, 0.33 Kg of a 40% solution of Dispex N-40 (manufactured by Allied Colloids) and 0.341 Kg of a 3.5% solution of 4-chloro-3.5 dimethyl phenol, a biocide sold under the trade designation Ottasept (by Ferro Corp.) After 5 minutes of mixing 119.75 Kg of anatase type titanium white pigment (Unitane 0-310, manufactured by Kemira Inc.) having a particle size of 0.2–0.3 μm was slowly introduced. Mixing was continued for 45 minutes after which an additional 11.43 Kgs of water were added and mixed for 15 minutes. The premix of TiO$^2$ described above was then dispersed using one pass through a 4-liter Netzsch media mill containing a 90% zirconium/silica media load under conditions of 80° F. temperature, 2300 rpm shaft speed and 0.669 liter/minute flow rate.

Preparation of Hydrophilic Colloid Coating Composition

Ingredients (1) through (5) in the amounts specified in Table I were added together in the order indicated in Table I. Conventional paddle stirrer mixing was used during each component addition with a 5 minute mix interval between additions. The 10% gelatin (component 6) was melted separately at 104° F. and pH adjusted to 8–9 using 2N NaOH. The mixture of components (1) through (5) were thereafter added to the gelatin with continued slow stirring for 30–45 minutes after addition was complete. pH of the final composition was then lowered to 5.0 using 1.6 N HN03.

The hydrophilic colloid coating composition was then coated simultaneously as the bottom layer with the emulsion layers.

EXAMPLE 4

CONTROL

The article of Example 1 was formed except that the following polyvinyl alcohol impregnated base paper was substituted:

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamideepichlorohydrin, 0.26% anionic polyacrylamide, and 5.0% TiO$^2$ on a dry weight basis. A 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using with polyvinyl alcohol as set forth below. The surface sized support was calendered to an apparent density of 1.04 gm/cc. This support was extrusion coated on the emulsion-facing side with polyethylene containing 12.5% TiO$^2$, and other addenda at 5.6 lb/ksf coverage. The opposite side was extrusion coated with polyethylene at 6.0 lb/ksf coverage. This support is identified as Example 1.

The paper was surface sized with a PVA solution instead of a starch solution. The polyvinyl alcohol (PVA) solution was prepared by adding 10percent by weight PVA, with 0.5 percent by weight NaCl, in water at temperatures less than 70° F.. This mixture was then heated to a minimum of 190° F. and held at this temperature until the PVA was dissolved. The solution was then cooled to 150° F. before applying to the paper base. The method of application was a tub size vertical size press as in FIG. 1*c*, and the sheet was passed through the PVA solution. After drying to a moisture of 3% using steam-heated dryers, the said PVA size paper was PVA tub-sized with the same solution a second time. This method of processing is called two-station sizing. The dried paper was then calendered to an apparent density of 1.04 g/cc. The paper was then extrusion coated in the same manner as Example 1.

The PVA pickup of 4.91 percent was measured using a gravimetric technique and reported as weight percent of bone dry sample weight.

Two values were measured to establish the oxygen barrier properties of the Example supports: 1) oxygen leak rate of 20 and 2) oxygen gas transmission rate of 0.1 ($O_2$ GTR). The $O_2$ GTR measurements were made according to ASTM D3985-81 on 50 $cm_2$ extrusion coated samples with the side to be emulsion coated facing the chamber with the oxygen sensor, at 100° F. and approximately 65% RH using pure oxygen. The oxygen leak rate was measured, using the same apparatus and test conditions, as follows: Nitrogen gas was introduced as the carrier gas in both the upper and lower chambers. After a suitable amount of time (30–180 minutes) the oxygen sensor was inserted into the lower chamber exhaust stream. Once equilibrium was established, the rate of oxygen reaching the sensor was recorded as the oxygen leak rate. The oxygen leak rate thus represents the rate that oxygen is reaching the sensor from 1) outgassing of the sample, 2) leaks in the system, and 3) leaks through the edge of the paper and diffusion through the polyethylene layer. Following the oxygen leak rate measurement, pure oxygen was introduced into the upper chamber (non-sensor side), and $O_2$ GTR measurements carried out as described above. All oxygen leak rate and $O_2$ GTR measurement in this specification assume a sample coated with 5 to 10 lbs./1000 sq. ft. of polyethylene polymer on each side. The polyethylene polymer is a conventional polymer used in resin coated paper.

The PVA used had a viscosity of 27–32 cps @4% water solution, 20° C., 99%+hydrolyzed.

EXAMPLE 5

CONTROL

The article of Example 3 was repeated except the polyvinyl alcohol polymer layer of Example 2 was again placed below the medium density resin coating.

EXAMPLE 6

The method of Example 5 was repeated except the resin coated polyvinyl alcohol impregnated base paper of Example 4 was used as the base paper.

Illustrated below are the layer structures of each of the examples. The RC refers to a polyethylene resin coating.

| |
|---|
| Example 1 |
| emulsion |
| RC |
| paper |
| RC |
| Example 2 |
| emulsion |
| RC |
| PVA (3.5 gm/m$^2$) |
| paper |
| RC |
| Example 3 |
| emulsion |
| $TiO_2$ and gelatin |
| RC |
| paper |
| RC |
| Example 4 |
| emulsion |
| RC |
| paper impregnated with PVA 10 g/m$^2$ |
| RC |
| Example 5 |
| emulsion |
| $TiO_2$ and gelatin |
| RC |
| PVA (3.5 gm/m$^2$) |
| paper |
| RC |
| Example 6 |
| emulsion |
| $TiO_2$ and gelatin |
| RC |
| paper impregnated with PVA 10 g/m$^2$ |
| RC |

The fog densities of the Examples 3, 5, and 6 with the invention colloidal $TiO_2$ are all lower when compared with those without the invention $TiO_2$. Modulation transfer function (MT), described in chapter 23 of the Photographic Process Third Edition, Edited by the MacMillan Company is used as a measure of printing image sharpness. The larger the value of the MT function, the better is the sharpness. It was found that the sharpness of Examples 3, 5, and 6 was also superior.

Table II below shows the results of a curl test on the six papers of the Examples. This illustrates that the PVA impregnated white pad containing color paper has less curl. It also has a sharper image and greater image stability.

TABLE II

| Example | ANSI 7-Day Disk Curl 50% RH, Pre-Process | Sharpness CMT |
|---|---|---|
| 1 | −1 | 92.1 |
| 2 - PVALayer | 19 | 92.4 |
| 3 - $TiO_2$ and gelatin | 13 | 95.9 |
| 4 - Impregnated PVA | 7 | 92.5 |
| 5 - PVA Layer & $TiO_2$ and gelatin | 21 | 96.1 |
| 6 - Impregnated PVA & $TiO_2$ and gelatin | 5 | 95.5 |

NOTE: Numbers closer to zero are more desirable.

The invention has been described in detail with particular reference to preferred embodiments thereof, but it will be understood that variations and modifications can be effected within the spirit and scope of the invention.

What is claimed is:

1. A photographic element comprising a paper substrate said paper substrate comprises wood fiber and polyvinyl alcohol polymer wherein said polyvinyl alcohol is located in heavier concentration near the surface of said paper with a polyolefin coating provided on at least one surface, a hydrophilic colloid layer on the polyolefin coating and a light sensitive silver halide emulsion on the hydrophilic colloid layer, said hydrophilic colloid layer comprising from about 20 to 80 percent by weight of a white pigment, and from about 15 to 35 percent by weight of hollow microspheres having a diameter of from about 0.1 to about 1 μm.

2. The photographic element of claim 1 wherein the hydrophilic colloid layer contains an optical brightener.

3. The photographic element of claim 1 wherein the white pigment is $TiO_2$.

4. The photographic element of claim 1 wherein the white pigment is anatase $TiO_2$.

5. The photographic element of claim 1 wherein the white pigment is rutile $TiO_2$.

6. The photographic element of claim 1 wherein the hydrophilic colloid is present in the amount of from about 5 to about 50 percent by weight.

7. The photographic element of claim 1 wherein the hydrophilic colloid is present in the amount of from about 8 to about 35 percent by weight.

8. The photographic element of claim 1 wherein the hydrophilic colloid is present in the amount of from about 10 to about 25 percent by weight.

9. The photographic element of claim 1 wherein the curl of said element is less than about 5 as measured by the ANSI 7-day Disk Curl Test.

10. The photographic element of claim 2 wherein the optical brightener is loaded on a latex polymer.

11. The photographic element of claim 1 wherein the hydrophilic colloid layer is coated at a coverage of at least about 5.4 g/m$^2$.

12. The photographic element of claim 1 wherein the hydrophilic colloid layer is coated at a coverage from about 5.4 g/m$^2$ to about 16.2 g/m$^2$.

13. The photographic element of claim 1 wherein the hydrophilic colloid layer is coated at a coverage from about 7.5 g/m$^2$ to about 10.9 g/m$^2$.

14. The element of claim 1 wherein said paper comprises between about 4 and about 6 percent by weight polyvinyl alcohol.

15. The element of claim 1 wherein the wood fiber comprising said paper comprises 50 to 100 percent by weight hardwood and 0 to about 50 percent by weight softwood.

16. The element of claim 1 wherein said paper has an $O_2$ leak rate of less than 25 cc/m$^2$/day.

17. The element of claim 1 wherein said paper has an $O_2$ GTR of less than 1 cc/m$^2$/day.

18. The element of claim 1 wherein said paper has a basis weight of between about 25 and about 50 lbs. per 1000 sq/ft.

19. The element of claim 1 wherein said photosensitive material comprises of at least one coupler selected from the group consisting of

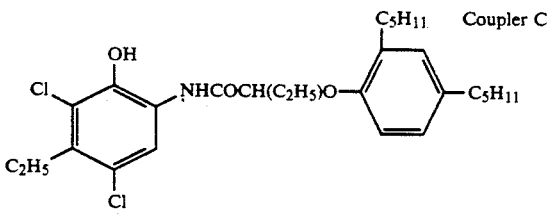

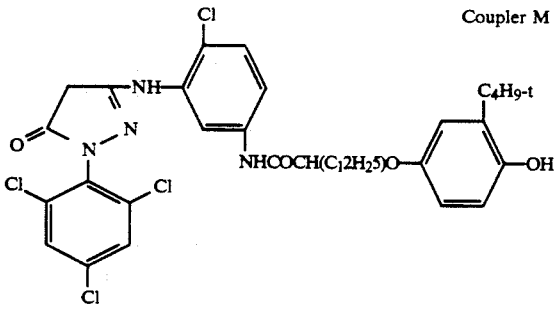

-continued

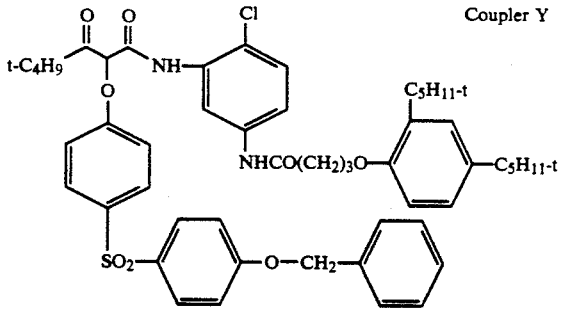

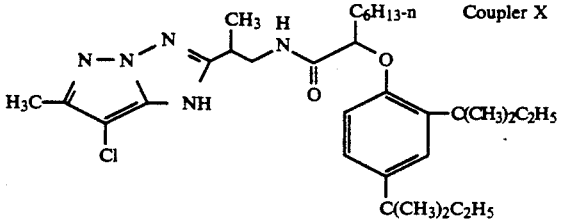

20. The imaging member of claim 1 wherein said photosensitive member comprises an ultraviolet absorber comprising

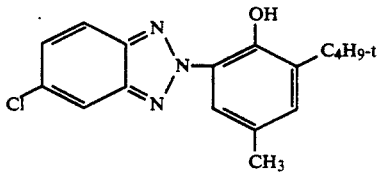

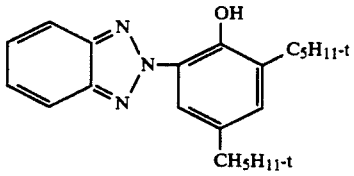

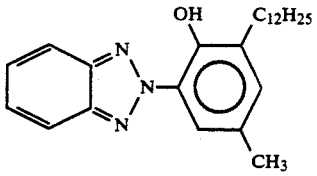

21. The element of claim 1 wherein said photosensitive membrane contains an ultraviolet absorber of the substituted phenylbenzotriazole class.

22. The element of claim 1 wherein said photosensitive material contains at least one yellow or magenta image forming coupler.

23. The element of claim 1 wherein said photosensitive material comprises magenta, yellow, and cyan image couplers.

* * * * *

UNITED STATES PATENT AND TRADEMARK OFFICE

CERTIFICATE OF CORRECTION

PATENT NO. : 5,234,804

DATED : August 10, 1993

INVENTOR(S) : E.M. Sato, et. al.

It is certified that error appears in the above-indentified patent and that said Letters Patent is hereby corrected as shown below:

In Column 17, second structure, delete "($C_12H_25$)" and insert --($C_{12}H_{25}$)--.

In Column 18, fourth structure, delete "$CH_5H$" and insert --$C_5H$--.

Signed and Sealed this

Fifth Day of April, 1994

Bruce Lehman

BRUCE LEHMAN

*Commissioner of Patents and Trademarks*

*Attest:*

*Attesting Officer*